United States Patent [19]

Fait

[11] Patent Number: 4,970,731

[45] Date of Patent: Nov. 20, 1990

[54] DEVICE FOR FASTENING COVERING ELEMENTS TO A SANITARY FIXTURE

[75] Inventor: Claudio Fait, Milano, Italy

[73] Assignee: American Standard Inc., New York, N.Y.

[21] Appl. No.: 357,754

[22] Filed: May 26, 1989

[30] Foreign Application Priority Data

Jun. 8, 1988 [IT] Italy ..... 34851/88[U]

[51] Int. Cl.[5] ..... A47K 13/12; A47K 13/00

[52] U.S. Cl. ..... 4/234; 4/236; 4/237; 4/240

[58] Field of Search ..... 4/234, 236, 237, 240, 4/235, 238, 239, 241; 16/252, 253, DIG. 40; 248/251, 201, 231.9, 231.91, 316.1, 231.2, 541; 411/34–38, 907, 908; 138/89; 403/240, 243, 239, 240

[56] References Cited

U.S. PATENT DOCUMENTS 534,018 2/1895 Stevens, Jr. ..... 4/236
3,449,774 6/1969 Wilham ..... 4/240
3,514,807 6/1970 Triplett ..... 16/253
3,570,021 3/1971 Watson ..... 4/240

FOREIGN PATENT DOCUMENTS 577310 6/1959 Canada ..... 138/89

*Primary Examiner*—Ernest G. Cusick
*Assistant Examiner*—David J. Walczak
*Attorney, Agent, or Firm*—Kaplan Blum

[57] ABSTRACT

A fastening assembly coupled to a hinge assembly of a sanitary fixture so that a seat and/or cover can be pivotably mounted thereto. The fastening assembly includes a deformable elastic bushing, which is positioned in each mounting hole provided on the rear shelf of the sanitary fixture, an internally threaded ring mounted in the lower end of the bushing, and a rod having a complimentary threaded lower end threadedly coupled to the threaded ring which deforms the bushing when drawn upwards to its mounted position. Thereafter, a hinge post is mounted over the upper end of the rod.

5 Claims, 2 Drawing Sheets

DEVICE FOR FASTENING COVERING ELEMENTS TO A SANITARY FIXTURE

BACKGROUND OF THE DISCLOSURE

Field of the Invention

This invention concerns a device to fasten covering elements onto a sanitary fixture, such as toilets or bidets, and particularly to a fastening apparatus to mount the corresponding seat/cover assemblies onto toilets.

CROSS REFERENCE TO A RELATED APPLICATION

In U.S. patent application Ser. No. 270,578 dated Nov. 14, 1988, Applicant's common Assignee, there is described a mounting assembly to couple a water tank to a water closet. The mounting assembly includes a threaded bolt, tubular elastomeric seal member and fastening means. The elastomeric member has centering ribs formed around its outer surface, a flanged head at one end and the other end is bifurcated. When the bolt is inserted therethrough, the elastomeric member expands in the tank mounting opening and the bifurcated end diverges to form a pair of latching tabs to prevent removal of the elastomeric seal member and bolt from the tank mounting opening.

DESCRIPTION OF PRIOR ART

It is known that a seat and cover assembly articulates at the rear of the corresponding fixture so that they can pivot in the vertical plane of symmetry thereof in order to occupy two opposing positions, respectively, raised and lowered.

To make available the support and articulation axis for the seat and cover, fastening systems comprising two opposing devices, shaped substantially like clamps, have been known for some time.

More particularly, the clamp devices consist of a threaded stem which is inserted into a hole in a rear shelf of the corresponding toilet and has, respectively, above and below the shelf, a seat designed to articulate the corresponding seat/cover assembly and a female threaded element, such as a wing nut, which is capable of tightening the clamp onto the shelf.

However, such known systems have proved to be disadvantageous due to the fact that in order to install, remove and, if necessary, adjust clamp devices, it is necessary to work in areas which are concealed and sometimes difficult to access, which makes the aforesaid operations particularly unpleasant and relatively long and complex. Specifically, in order to tighten and loosen the clamps, it is necessary to work below the rear shelf of a toilet, which is especially inconvenient when deposits and/or incrustations have formed on the lower end of the clamps, for example, due to the usual detergents employed to clean the corresponding toilet.

SUMMARY OF THE INVENTION

The principal object of this invention is to provide an attachment device for a seat and/or cover assembly for a sanitary fixture which overcomes the above disadvantages by use of a simple and rational design solution.

Another object of the invention is to provide a system for mounting a seat and/or cover assembly to a sanitary fixture by performing all operations necessary for its installation and its removal from above the sanitary fixture and, thereby, providing easy access to the work area while in a comfortable position.

The invention relates to a device for mounting a covering element, such as a seat and/or cover assembly, to the holes provided at the rear flat region of a sanitary fixture, such as a toilet. A bushing, made of an elastic, deformable material such as rubber, is in the form of an elongated tubular member, one end of which has an integrally formed flange. The diameter of the tubular member is substantially equal to the diameter of the holes formed in the toilet so as to be insertable therein without substantial deformation. The length of the bushing is greater than the depth of the flat region so that it is insertable from the top and extends through the flat region. A threaded deformation ring is positioned adjacent to the other end of the tubular member and is held in place by an annular recess formed in the walls of the tubular member. A retaining washer, having a recess, is seated on the flange of the tubular member, the washer having a central opening which is coaxial with the bore of the tubular member. An elongated rod, having a threaded lower segment and an upper segment of greater diameter than the lower segment, forms a shoulder between each segment. The end of the upper segment is provided with a drive socket and releasable latch means to mount hinge post or bracket thereon.

The deformation ring, because it is countersunk into the bushing, causes expansion transversely by drawing the bushing upwards when the threaded portion is screwed into the ring, which simultaneously immobilizes the rod in the mounting hole of the sanitary fixture.

BRIEF DESCRIPTION OF THE DRAWINGS

These and other objects of the invention will become evident from the detailed description which follows, given with reference to the attached FIGURES, in which.

DETAILED DESCRIPTION OF THE PREFERRED EMBODIMENT

Figure 1:
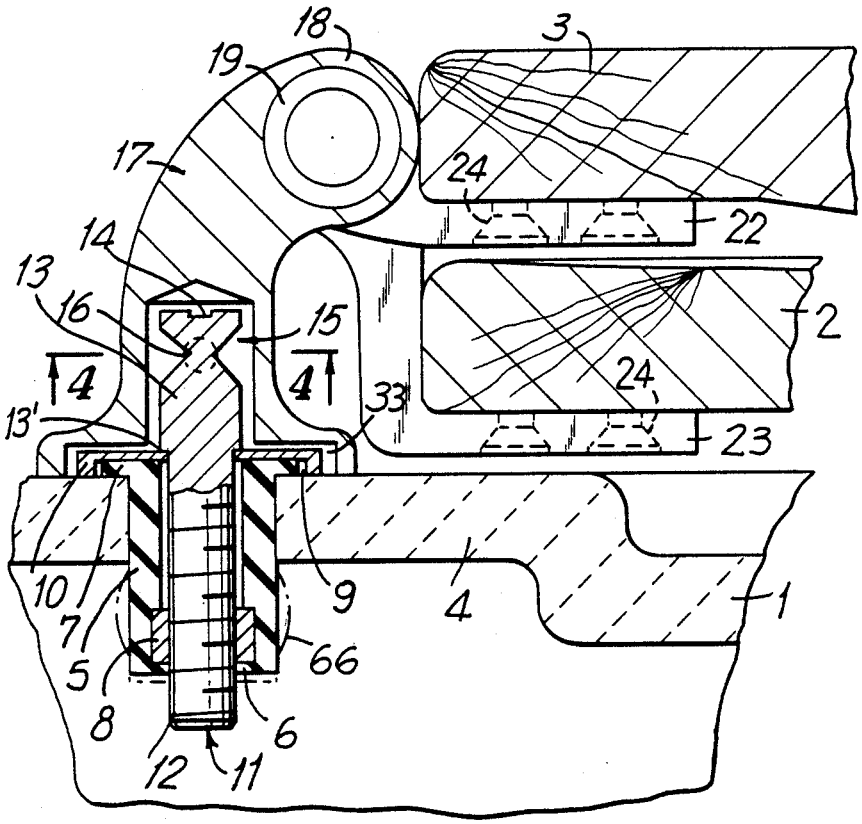
FIG. 1 is an enlarged fragmentary sectional view, taken along line I—I of FIG. 2.

In the drawings, only that portion of the toilet is shown that relates to use of the invention. Referring to the drawings, in FIG. 1 is shown a toilet 1, and a seat 2 and cover 3 which are mounted to toilet 1, as will be described hereinafter. Toilet 1 has at its rear region, an essentially horizontal shelf 4 which is provided with two orthogonal holes 5 which are placed symmetrically with respect to the vertical plane of symmetry of toilet 1.

Inserted into each individual mounting hole 5, and fitting almost precisely, is a bushing 6 made of an elastic deformable material, for example, rubber. Bushing 6 is in the form of an elongated tube with a circumferential flange 7 at one end thereof. Bushing 6 has a length greater than the thickness of shelf 4, and has countersunk in an annular recess at its lower end, an internally threaded coaxial metal ring 8.

Figure 4:
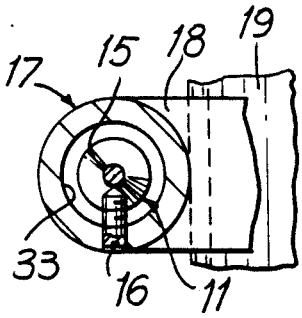
FIG. 4 is a sectional view, taken along line IV—IV of FIG. 2.
Figure 3:
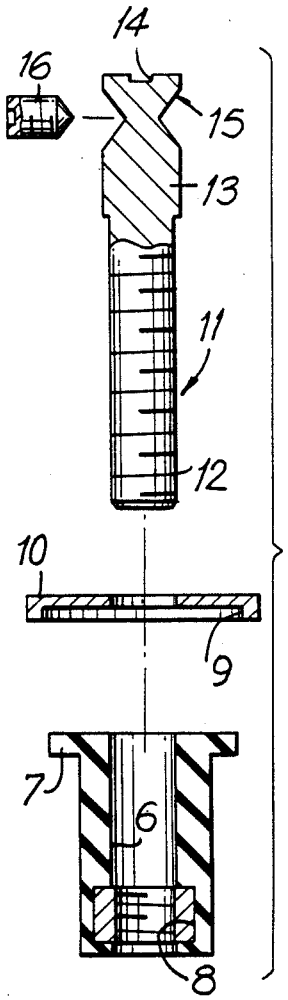
FIG. 3 is an exploded view, in section, of the attachment assembly shown in FIG. 1.

A disc 10 is formed having an upper flat surface and an axial opening or hole which is coaxial with the bore of bushing 6. The depth of the recess 9 formed in disc 10 is less than the thickness of flange 7, so that disc 10 is spaced from shelf 4 when in its unmounted position, see FIG. 3, and when the hinge assembly is in its mounted position, the peripheral rim defining the annular recess 9 rests on shelf 4, see FIG. 1. As noted from FIG. 1, when bushing 6 is mounted in position, the elongated tubular segment extends beyond the thickness of shelf 4. The internally formed annular recess, which is adjacent the lower end of bushing 6, provides a seat in which internally threaded coaxial ring 8 is mounted. An elongated rod 11 has a threaded lower segment or stem 12 and an upper segment 13 of greater diameter than the lower segment 12, which forms a shoulder 13' between each segment. The end portion of upper segment 13 is provided with a drive socket 14 which, as illustrated in FIG. 3, is a diametrically formed slot to accommodate a screwdriver. Formed below drive slot 14 is a circumferential groove 15, which is triangular in section and acts as a coupling seat for the pointed end of a screw 16. Such as a set screw of the type having a recess hexagonal socket, shown in FIGS. 3 and 4. Bracket 17 is in the form of a post, one end of which pivotally mounts seat 3 and cover 4, and its other end is formed with an annular recess and coaxial bore which, when positioned on shelf 4, nests in telescopic relation with rod segment 13 and disc 10, see FIG. 1. Bracket 17 is provided with a transversely threaded hole in which set screw 16 is threaded with its pointed end seated against circumferential groove 15.

When rod 11 is inserted into bushing 6, its threaded end engages coaxial threaded ring 8 and is tightened until shoulder 13' engages disc 10 and its peripheral rim seats against shelf 4. At the same time, coaxial ring 8 and the lower portion of bushing 6 is deformed by coaxial ring 8, bushing 6 is drawn upwards as rod 11 is tightened, shown by the broken lines 66 in FIG. 1.

Figure 2:
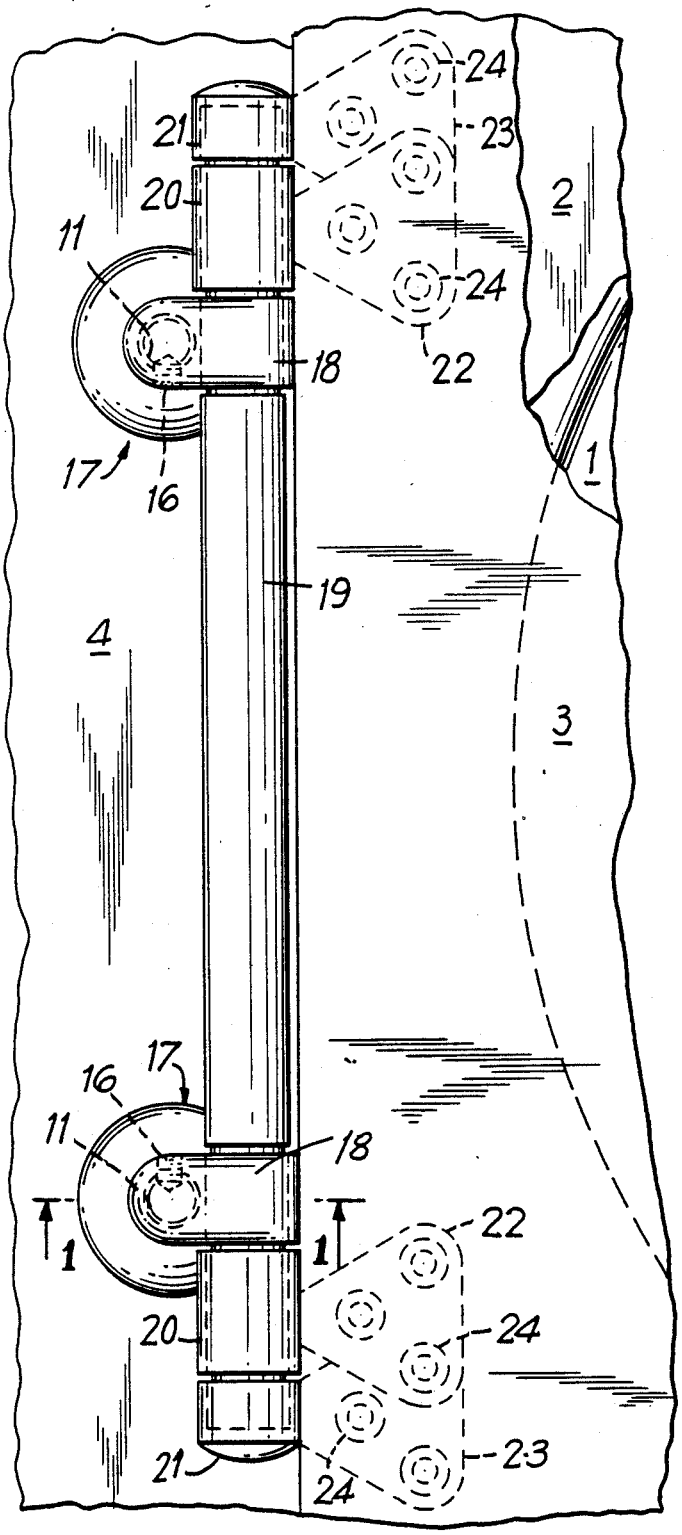
FIG. 2 is a top view thereof.

Threaded holes are formed in bracket 17 on its inward face to conceal set screws 16 when mounted in position. Each bracket 17 is curved toward the front of toilet 1, from its base to its outer end, which terminates in knuckle 18 having a transverse bore in which pintle or bar 19 is inserted to provide the pivot axis for seat 3 and cover 4. Bar 19 extends beyond bracket 17 so that knuckles 20 of attachment plates 22,23, seat 3 and cover 4 are pivotally mounted thereon. Seat 3 and cover 4 are mounted to attachment plates 22,23 by self-tapping screws 24, see FIG. 2. A cap 21 is mounted at each end of bar 19 to hold both seat 3 and cover 4 in position.

I claim:

1. A fastening assembly to couple a seat and/or cover to a sanitary fixture, said assembly comprising:

an elongated tubular bushing comprised of two ends, having an axial bore formed therethrough, is made of a deformable elastic material and includes an integrally formed flange at one end;

an internally threaded ring, coaxially positioned in said bore of said tubular bushing, and mounted adjacent its other end;

a disc having a flat upper surface and a lower surface, an annular recess formed in its lower surface having a depth less than the thickness of said flange formed at one end of said bushing, and a central opening coaxially aligned with said bore of said tubular body, is positioned in overlying relation to said flange;

an elongated rod having an upper segment of greater diameter than said bore of said tubular bushing and said central opening of said disc, and a lower complimentary threaded segment whose diameter is substantially equal to said bore of said tubular member to form a stop at the junction of said upper and lower segments so that when said rod is inserted through the central opening of said disc and into the bore of said bushing, the threaded end of said rod threadedly engages said internally threaded ring, said elongated tubular bushing is drawn upwardly which deforms said bushing transversely and mounts said assembly in fixed position on said sanitary fixture.

2. The fastening assembly of claim 1 wherein said bushing is formed having an internal annular recess formed adjacent its other end to provide a seat to mount said internally threaded ring therein.

3. The fastening assembly of claim 1 wherein said upper segment of said rod includes a drive socket formed at its upper end to provide means to threadedly couple and uncouple said rod from said internally threaded ring.

4. A fastening assembly to couple a seat and/or cover to a sanitary fixture, said assembly comprising:

an elongated tubular bushing comprised of two ends, having an axial bore formed therethrough, is made of a deformable elastic material and includes an integrally formed flange at one end;

an internally threaded ring, coaxially positioned in said bore of said tubular bushing, and mounted adjacent its other end;

a disc having a flat upper surface and a lower surface, an annular recess formed in its lower surface, and a central opening coaxially aligned with said bore of said tubular body, is positioned in overlying relation to said flange;

an elongated rod having an upper segment of greater diameter than said bore of said tubular bushing and said central opening of said disc, and a lower complimentary threaded segment whose diameter is substantially equal to said bore of said tubular member to form a stop at the junction of said upper and lower segments so that when said rod is inserted through the central opening of said disc and into the bore of said bushing, the threaded end of said rod threadedly engages said internally threaded ring, said elongated tubular bushing is drawn upwardly which deforms said bushing transversely and mounts said assembly in fixed position on said sanitary fixture; and a circumferential groove is formed in said upper segment of said rod adjacent its upper end to provide a seat for a set screw.

5. The fastening assembly of claim 4 includes a bracket comprised of two ends, having means formed at one end adapted to receive attachment plates to pivotally mount said seat and/or cover thereto, an annular recess, including a central bore coaxially formed with said central opening of said disc, is formed at the other end so that said bracket is telescopically positioned over said upper segment of said rod and said flange, a set screw, and a transverse threaded opening for receiving said set screw formed in said bracket which is aligned with said circumferential groove in which said set screw rigidly couples said bracket to said rod.

* * * * *